US012209851B2

(12) United States Patent
Muller et al.

(10) Patent No.: US 12,209,851 B2
(45) Date of Patent: Jan. 28, 2025

(54) DETONATOR ASSEMBLY

(71) Applicant: DETNET SOUTH AFRICA (PTY) LTD, Johannesburg (ZA)

(72) Inventors: Elmar Lennox Muller, Johannesburg (ZA); Abraham Johannes Liebenberg, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 107 days.

(21) Appl. No.: 18/247,466

(22) PCT Filed: Sep. 28, 2021

(86) PCT No.: PCT/ZA2021/050054
§ 371 (c)(1),
(2) Date: Mar. 31, 2023

(87) PCT Pub. No.: WO2022/073042
PCT Pub. Date: Apr. 7, 2022

(65) Prior Publication Data

US 2023/0417525 A1 Dec. 28, 2023

(30) Foreign Application Priority Data

Oct. 1, 2020 (ZA) ..... 2020/06083

(51) Int. Cl.
*F42D 1/05* (2006.01)

(52) U.S. Cl.
CPC ..... *F42D 1/05* (2013.01)

(58) Field of Classification Search
CPC ..... F42D 1/05
USPC ..... 102/206
See application file for complete search history.

(56) References Cited

U.S. PATENT DOCUMENTS

| | | | | |
|---|---|---|---|---|
| 2006/0042495 | A1* | 3/2006 | Russell | F42D 1/05 102/217 |
| 2009/0145321 | A1* | 6/2009 | Russell | F42D 1/05 102/200 |
| 2017/0074625 | A1* | 3/2017 | Appleby | F42B 3/113 |
| 2020/0191539 | A1* | 6/2020 | Muller | F42D 1/05 |
| 2021/0003377 | A1* | 1/2021 | Monroe | F42D 1/05 |

FOREIGN PATENT DOCUMENTS

CA 3109412 A1 2/2020

OTHER PUBLICATIONS

International Search Report and Written Opinion for Related Application No. PCT/ZA2021/050054 dated Dec. 10, 2021 (9 pages).
(Continued)

*Primary Examiner* — Samir Abdosh
(74) *Attorney, Agent, or Firm* — Michael Best & Friedrich LLP

(57) ABSTRACT

A detonator assembly which includes a detonator arrangement comprising a detonator, a receiver which is responsive to a magnetic signal from a control centre and a control circuit which, in response to a signal from the receiver, regulates firing of the detonator, and which is characterised in that a fibre optic cable is connected to and extends from the detonator arrangement, and in that the detonator arrangement includes a transmitter/receiver module which is in signal communication with the fibre optic cable and the control circuit.

5 Claims, 1 Drawing Sheet

(56) References Cited

OTHER PUBLICATIONS

International Preliminary Report on Patentability for Related Application No. PCT/ZA2021/050054 dated Dec. 23, 2022 (7 pages).
Annex to International Preliminary Examination Report for Related Application No. PCT/ZA2021/050054 dated Dec. 23, 2022 (8 pages).

* cited by examiner

DETONATOR ASSEMBLY

CROSS REFERENCE TO RELATED APPLICATIONS

This application is a U.S. National Phase application of International Application No. PCT/ZA2021/050054, filed Sep. 28, 2021, which claims priority to South African Patent Application No. 2020/06083, filed Oct. 1, 2020, the entire contents of both of which are herein incorporated by reference.

BACKGROUND OF THE INVENTION

This invention relates to a detonator assembly. The invention is described hereinafter with reference to the use of a detonator assembly in a unidirectional wireless through-the-earth initiation blasting system but this is exemplary and non-limiting.

In a blasting system of the aforementioned kind magnetic signals are transmitted from a control centre via a loop antenna which is positioned around a blast site. A number of boreholes are formed at the blast site and each borehole contains one or more detonator assemblies. Communication is unidirectional i.e. only from the control centre to each detonator assembly. Typically each detonator assembly does not have sufficient on-board energy to transmit a return signal though the earth to the control centre. It is however essential to ensure that each detonator assembly reliably receives magnetic signals from the control centre and is responsive thereto. US 2017/0074625 describes a blasting system in which a magnetic signal is sent through the earth to a number of detonators and each detonator is then fired by means of a light signal. In CA 3109412 detonators, which can be initiated by means of a magnetic signal from a controller, can communicate with the controller by passing signals through rock between a chain of detonators. In US 2020/091539 a controller communicates wirelessly with receivers which, in turn, communicate via fibre optic cables with detonators.

An object of the invention is to provide a detonator assembly which, at least in some deployment situations, enables the functioning of the detonator assembly to be monitored.

SUMMARY OF THE INVENTION

The invention provides a detonator assembly which includes a detonator arrangement comprising a detonator, a receiver which is responsive to a magnetic signal from a control centre and a control circuit which, in response to a signal from the receiver, regulates firing of the detonator, and which is characterised in that a fibre optic cable is connected to and extends from the detonator arrangement, and in that the detonator arrangement includes a transmitter/receiver module which is in signal communication with the fibre optic cable and the control circuit.

In the detonator arrangement the principal operations thereof are regulated by means of magnetic signals received by the receiver and transferred to the control circuit.

Status signals relating to the detonator arrangement, e.g. notification of sleep or arm modes, can be transmitted via the fibre optic cable to a remote end thereof. Conversely, predetermined signals which may be of an interrogating or command nature, can be transmitted via the fibre optic cable to the transmitter/receiver module for processing by the control circuit. Such predetermined signals exclude all signals which could lead to firing of the detonator.

Under dark conditions, e.g. if the detonator arrangement is used in an underground situation, light which is emitted from an end of the fibre optic cable which is remote from the detonator arrangement is visible. That light enables the position of a detonator arrangement to be ascertained and also indicates that a detonator assembly has been deployed in the respective blast hole.

The invention also provides a method of operating a detonator assembly which includes a detonator arrangement and a fibre optic cable which at one end is connected to the detonator arrangement and which, at an opposing end, forms a communication interface, wherein the method includes the steps of deploying the detonator arrangement (28) in a borehole whereby the fibre optic cable which extends in the borehole from the detonator arrangement and the communication interface is located at a mouth of the borehole, engaging in two-way communication with the detonator arrangement via the communication interface and, when required, of transmitting a fire command to the detonator arrangement using a through-the-earth magnetic signal from a control centre.

BRIEF DESCRIPTION OF THE DRAWING

The invention is further described by way of example with reference to the accompanying drawings in which.

DESCRIPTION OF PREFERRED EMBODIMENT

Figure 1:
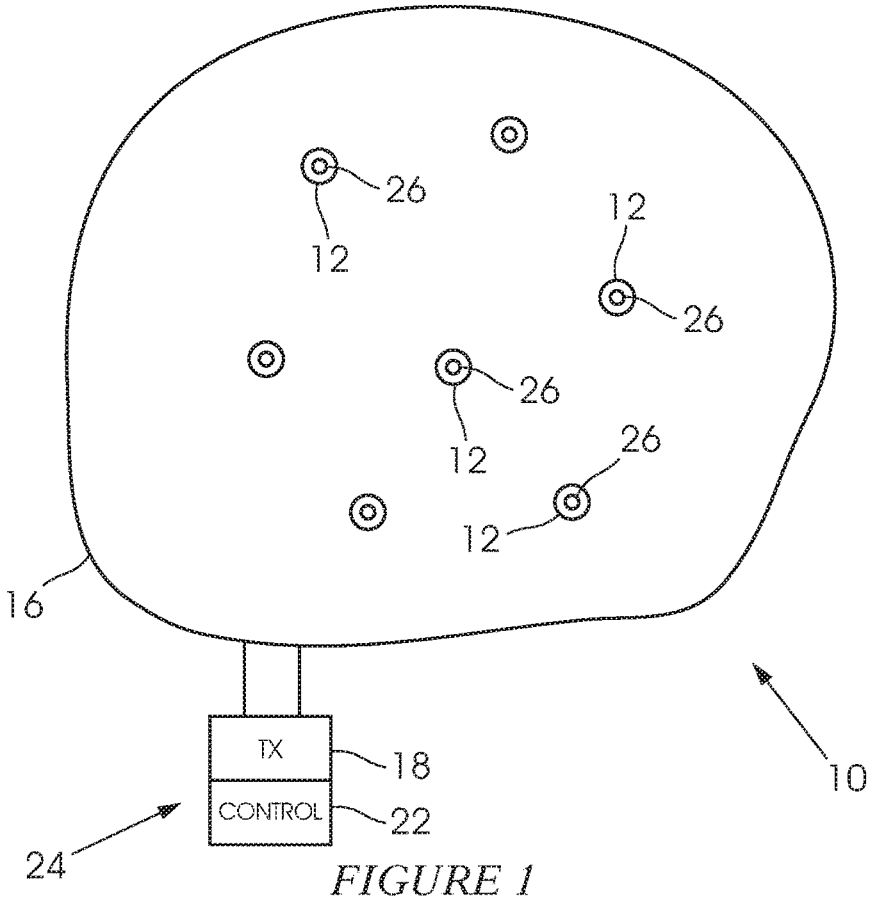
FIG. 1 depicts a blast site which includes a plurality of detonator assemblies.

FIG. 1 of the accompanying drawings schematically depicts a blast site 10 which can be on surface or underground, depending on requirement. A plurality of spaced apart boreholes 12 are formed within the blast site. The site is surrounded by a loop antenna 16 which is connected to a magnetic signal transmitter 18 which functions under the control of a blast controller 22 at a control centre 24. Associated with each borehole 12 is a respective detonator assembly 26.

Figure 2:
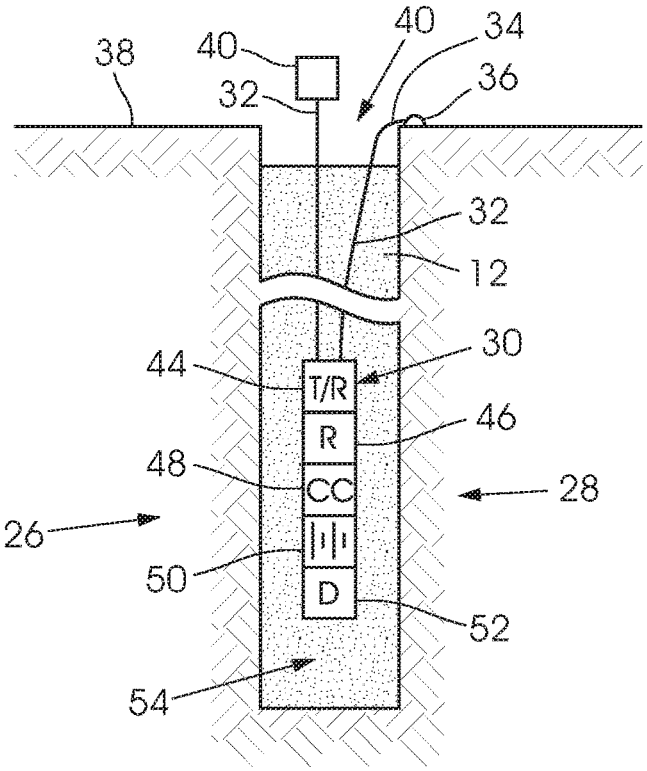
FIG. 2 shows a detonator assembly according to the invention.

Each detonator assembly 26 (see FIG. 2) comprises a detonator arrangement 28 which includes a housing 30 from which extends an elongate fibre optic cable 32 and a support line 34 which is tethered to an anchor 36 at ground level 38. The fibre optic cable 32, at an end which is remote from the housing 30, is positioned at a visible and accessible location at ground level 38. Optionally the end is connected to a terminating unit 40. The unit 40 may comprise a transparent cap or the like which overlies the end. What is required in this regard in that a communication interface 42 is formed at the mouth 43 of the borehole by the exposed end of the fibre optic cable, or by the terminating unit 40 which is fixed to the end.

Positioned inside or attached to the housing 30 are a transmitter/receiver module 44, a receiver 46, a control circuit 48, a power source 50 and a detonator 52. An explosive material 54 inside the borehole 12 is exposed to the detonator 52, as is known in the art.

The module 44 is directly connected to an end of the fibre optic cable 32 and is capable of receiving signals transmitted at light frequency via the cable 32. In the return direction the module 44 can transmit signals at light frequency, which signals are generated by the control circuit 48, to the communication interface 42. Signals from the module 44 are emitted at a visible light frequency by the communication interface 42 and, conversely, light signals which are incident on the interface 42 are transmitted via the cable 32 to the transmitter/receiver 44. Thus, through the use of a transmitter/receiver (not shown) which preferably is mobile and carried by an operator, two-way communication with the control circuit 48 is possible.

The receiver 46 is responsive to magnetic signals which are transmitted from the control centre 24 via the loop antenna 16. The control circuit 48, in response to arm and fire signals from the control centre 24, can cause the detonator 52 to initiate and fire the explosive 54. This aspect is conventional.

Operation of the detonator assembly 26 is powered by means of energy drawn from the power source 50.

The detonator assemblies 26 are deployed in the various boreholes 12 in a conventional manner. Each detonator arrangement 28 is suspended from the respective support line 34.

In general terms the firing aspect of the system is unidirectional in that essential control and operational instructions are transmitted from the transmitter 18 to each of the detonator arrangements 28 by means of magnetic signals, typically through the earth. The receiver 46 in each detonator arrangement detects such magnetic signals and, as is known in the art, the control circuit 48, in response to the detected magnetic signals, controls arming and firing operation of the detonator 52.

Although each detonator arrangement 28 includes a power source 50 to enable the arrangement to function, the power output of the source 50 is not adequate to enable communication from the detonator arrangement to the control centre 24 to take place via through-the-earth transmission. The use of the fibre optic cable 32 does however allow a degree of limited two-way communication to take place with the detonator arrangement. A mobile interrogating unit, not shown, carried for example by an operator, can be coupled to the communication interface 42 and signals can be transmitted via the cable 32 to the transmitter/receiver module 44. The signals are processed by the control circuit 48 and return signals are transmitted from the transmitter/receiver module 44 via the cable 32 to the interface 42, at which point the signals, at light frequency, are detected by the interrogating unit.

Through the use of the fibre optic cable 32 a technician at a mouth 43 of the borehole can access the interface 42 and communicate to a limited extent, in a bidirectional manner, with the control circuit 48 in the detonator arrangement 28. The extent of this communication is dependent, at least, on the power which is available from the power source 50. Information on the strength of a magnetic signal transmitted from the control centre 24 and previously detected by the receiver 46 and stored in a memory in the control circuit 48, can be transmitted to the interrogating unit. This makes it possible for the light signal from the communication interface 42 to convey information on the status of the detonator arrangement 28 e.g. whether the detonator arrangement is in an awake or a sleep mode, whether the detonator arrangement has received an arm or synchronising signal, or the like. Of vital importance is the capability of the arrangement to indicate, via a signal which is transmitted from the communication interface 42, whether a magnetic control signal transmitted through the earth from the control centre 24, will be reliably received by the control circuit 48.

Light which is emitted from the interface 42 is also useful in identifying the position of a detonator assembly and of indicating (confirming) that a respective detonator assembly has been deployed into a borehole.

The invention claimed is:

1. A blast site (10) which includes a blast controller (22) at a control centre (24), a plurality of spaced apart at boreholes (12), a magnetic signal transmitter (18), a loop antenna (16) which surrounds the boreholes (12) and which is connected to the magnetic signal transmitter (18) and a plurality of detonator assemblies (26), each detonator assembly (26) being associated with a respective borehole (12) and including a detonator arrangement (28) which is positioned inside a borehole (12) and which comprises a housing (30) and, positioned inside or attached to, the housing (30) a detonator (52), a control circuit (48) and a transmitter/receiver module (44) which is in signal communication with the control circuit (48), a fibre optic cable (32) which is connected at a first end to the detonator arrangement (28), and a communication interface (42) which, in use, is formed at a second end of the fibre optic cable (32) at a mouth (43) of the borehole, characterised in that, in respect of each detonator assembly (26) the module (44) is capable of bidirectional communication via the fibre optic cable (32) at light frequency via the communication interface (42) with a mobile interrogating device and in that each detonator arrangement (28) respectively includes, positioned inside or attached to the housing (30) a magnetic signal receiver (46) which is responsive to a magnetic signal transmitted by the magnetic signal transmitter (18) which functions under the control of the blast controller (22), and in that the control circuit (48), in response to a signal from the magnetic signal receiver (46) regulates firing of the detonator (52).

2. A blast site (10) according to claim 1 characterised in that, for each detonator assembly (26) the respective communication interface (42) is formed at the mouth (43) of the borehole by an exposed second end of the fibre optic cable (32) or by a terminating unit (40) which is fixed to the second end of the fibre optic cable (32).

3. A blast site (10) according to claim 1 characterised in that it includes a support line (34) configured to hold the detonator arrangement (28) at a predetermined position in the respective borehole (12).

4. A method of operating a detonator assembly (26) which includes a detonator arrangement (28) and a fibre optic cable (32) which at a first end is connected to the detonator arrangement (28) and which at a second opposing end forms a communication interface (42), wherein the method includes the steps of deploying the detonator arrangement (28) in a borehole (12) whereby the fibre optic cable (32) extends in the borehole from the detonator arrangement (28) and the communication interface (42) is located at a mouth (43) of the borehole (12), engaging in two-way communication at a light frequency with the detonator arrangement (28) via the communication interface (42) and, when required, of transmitting a fire command to a magnetic signal receiver (46) in the detonator arrangement (28) using a through-the-earth magnetic signal from a magnetic signal transmitter (18) at a control centre (24).

5. A method of establishing and operating a blast site which includes the steps of forming a plurality of spaced apart boreholes at the site, placing a loop antenna (16) to surround the boreholes, connecting a magnetic signal transmitter to the loop antenna, providing a plurality of detonator assemblies (26) and placing each detonator assembly (26) into a respective borehole (12) characterised in that, for each detonator assembly (26) two-way communication with a control circuit in the detonator assembly is established by means of a mobile interrogating unit, carried by an operator, which is coupled to a respective communication interface in the detonator assembly whereby signals are transmitted at a light frequency via a fibre optic cable (32) between the interrogating unit and a respective transmitter/receiver module (44) in the detonator assembly and in that, when required, of transmitting a fire command to a magnetic signal receiver in the detonator assembly using a through-the-earth magnetic signal from the magnetic signal transmitter.

* * * * *